US010559417B2

(12) United States Patent
Ohkubo et al.

(10) Patent No.: US 10,559,417 B2
(45) Date of Patent: Feb. 11, 2020

(54) COIL COMPONENT

(71) Applicant: TDK CORPORATION, Tokyo (JP)

(72) Inventors: Hitoshi Ohkubo, Tokyo (JP); Masazumi Arata, Tokyo (JP); Manabu Ohta, Tokyo (JP); Yuuya Kaname, Tokyo (JP); Yoshihiro Maeda, Tokyo (JP); Takahiro Kawahara, Tokyo (JP); Hokuto Eda, Tokyo (JP); Shigeki Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 62 days.

(21) Appl. No.: 15/166,519

(22) Filed: May 27, 2016

(65) Prior Publication Data

US 2016/0351316 A1 Dec. 1, 2016

(30) Foreign Application Priority Data

May 29, 2015 (JP) ..... 2015-110591

(51) Int. Cl.
*H01F 5/00* (2006.01)
*H01F 27/32* (2006.01)

(52) U.S. Cl.
CPC ..... *H01F 27/325* (2013.01)

(58) Field of Classification Search
CPC .. H01F 27/255; H01F 27/2804; H01F 27/325; H01F 17/0006; H01F 17/0013; H01F 2017/048; H01F 41/26; H01F 41/309; H01F 10/30; H01F 27/323
USPC ..... 336/200, 223, 232, 233; 29/602.1, 605, 29/606; 257/531
See application file for complete search history.

(56) References Cited

U.S. PATENT DOCUMENTS

2004/0164835 A1 8/2004 Shoji
2013/0222101 A1* 8/2013 Ito ..... H01F 17/04 336/83
2013/0249662 A1* 9/2013 Tonoyama ..... H01F 27/255 336/200
2014/0009254 A1* 1/2014 Ohkubo ..... H01F 27/2804 336/192
2015/0035634 A1* 2/2015 Nakamura ..... H01F 17/0013 336/170
2015/0035640 A1* 2/2015 Wang ..... H01F 17/0006 336/200
2016/0071643 A1* 3/2016 Heo ..... H01F 41/041 336/200
2016/0336105 A1* 11/2016 Choi ..... H01F 17/0013

FOREIGN PATENT DOCUMENTS

CN 1523617 A 8/2004
CN 103180919 A 6/2013
JP 2005-210010 A 8/2005
JP 2015-032625 A 2/2015

* cited by examiner

*Primary Examiner* — Mang Tin Bik Lian
(74) *Attorney, Agent, or Firm* — Oliff PLC

(57) ABSTRACT

A coil component in which a change in thicknesses of the winding part is prevented is provided. According to the coil component, since each of a pair of neighboring resin walls and a seed part between the pair of resin walls are separated by a predetermined distance, a plating part grown on the seed part is easy to grow uniformly between the pair of neighboring resin walls. For this reason, the winding part whose surface is gentle and in which a change in thickness is prevented is obtained by plating growth.

10 Claims, 10 Drawing Sheets

COIL COMPONENT

CROSS-REFERENCE TO RELATED APPLICATIONS

This application is based upon and claims the benefit of priority from Japanese Patent Application No. 2015-110591, filed on May 29, 2015, the entire contents of which are incorporated herein by reference.

TECHNICAL FIELD

The present invention relates to a coil component.

BACKGROUND

Conventionally, coil components such as surface-mounted planar coil elements, etc. have been widely used for electric appliances such as household apparatuses, industrial apparatuses, and so on. Especially, in small portable devices, with the fulfillment of functions, there has occurred a need to obtain a plurality of voltages from a single power source in order to drive the respective devices. Here, the surface-mounted planar coil element is used also for this power source purpose, or the like.

Such a coil component is disclosed in, for instance, Japanese Unexamined Patent Publication No. 2005-210010. In the coil component disclosed in this document, planarly spiraled air core coils are provided on front and rear surfaces of a board respectively, and the air core coils are interconnected by a through-hole conductor provided to pass through the board at magnetic core portions of the air core coils.

SUMMARY

The aforementioned air core coil is formed by causing a plating growth of a conductor material such as Cu on a seed pattern provided on the board, but an interval of winding part of the coil is narrowed by the plating growth in an in-plane direction of the board. When the interval of the winding part of the coil is narrowed, a technique of more reliably insulating is desired because there is a concern that an insulation property of the coil is deteriorated.

Thus, development of a technique for providing a resin wall in the interval of winding part of the coil to ensure reliable insulation is underway. However, when the winding part of the coil is formed by the plating growth, the winding part is grown while being inclined to the board, which causes part of a surface of the winding part to be greatly recessed, and the winding part whose thickness is greatly changed is obtained.

According to the present disclosure, a coil component in which a change in thickness of the winding part is prevented is provided.

A coil component according to an aspect of the present disclosure includes: a board; a coil provided on a main surface of the board and having a seed part disposed on the main surface of the board and a plating part subjected to plating growth on the seed part; a resin body provided on the main surface of the board and having a plurality of resin walls between which winding part of the coil extends; and a covering resin composed of a magnetic powder-containing resin and configured to integrally cover the coil and the resin body of the main surface of the board, wherein each of a pair of neighboring resin walls and the seed part between the pair of resin walls are separated by a predetermined distance.

In the coil component, since each of the pair of neighboring resin walls and the seed part between the pair of resin walls are separated by a predetermined distance, the plating part grown on the seed part is easy to grow uniformly between the pair of neighboring resin walls. For this reason, the winding part whose surface is gentle and in which a change in thickness is prevented is obtained by the plating growth.

Further, there may be an aspect in which the seed part between the pair of resin walls is formed at least at a middle position between the pair of neighboring resin walls. In addition, there may be an aspect in which each of the pair of neighboring resin walls and the seed part between the pair of resin walls are separated by an equal distance. In these cases, the winding part having a symmetrical shape with respect to the middle position between the pair of neighboring resin walls is easily obtained, and the change in thickness is further prevented.

Further, there may be an aspect in which, when a width of the seed part between the pair of resin walls is defined as W1, and an interval between the pair of resin walls is defined as W2, $W1/W2 \geq 1/5$. In this case, the seed part has a sufficient bonding force for the board, and a situation in which the seed part is peeled from the board is prevented.

Further, there may be an aspect in which cross section shape of the resin wall of the resin body is rectangular shape. At this point, there may be an aspect in which aspect ratio of the resin wall of the resin body is greater than 1, and the resin wall extends long in normal direction of the main surface of the board.

Further, there may be an aspect in which cross section shape of the winding part of the coil is rectangular shape. At this point, there may be an aspect in which aspect ratio of the winding part of the coil is greater than 1, and cross section of the winding part extends long in normal direction of the main surface of the board.

Further, there may be an aspect in which the resin wall of the resin body is higher than the winding part of the coil. In this case, the winding part can have a thickness according to a design size over a height direction. Also, a situation in which the winding part goes beyond the resin wall to come into contact with each other is significantly avoided Further, there may be an aspect in which the resin body is provided before the coil is subjected to plating growth on the main surface of the board, and the winding part of the coil is not bonded to the resin wall of the resin body.

Further, there may be an aspect in which, among the plurality of resin walls arranged on the main surface of the board, the resin wall located outermost is thicker than the resin wall located inside thereof.

DETAILED DESCRIPTION

Hereinafter, embodiments of the present disclosure will be described with reference to the attached drawings. Note that, in the description, the same elements or elements having the same function are designed to use the same sign, and duplicate description thereof will be omitted.

First, a structure of a coil component according to an embodiment of the present disclosure will be described with reference to FIGS. 1 to 4. For the convenience of description, XYZ coordinates are set as illustrated. That is, a thickness direction of a planar coil element is set to a Z direction, a facing direction of external terminal electrodes is set to a Y direction, and a direction orthogonal to the Z direction and the Y direction is set to an X direction.

The coil component 1 is made up of a body section 10 having an approximately cuboid shape, and a pair of external terminal electrodes 30A and 30B that are provided to cover a pair of end faces facing the body section 10. The coil component 1 is designed with dimensions of a 2.0 mm long side, a 1.6 mm short side, and a 0.9 mm height by way of example.

Hereinafter, with showing a procedure for manufacturing the body section 10, a structure of the coil component 1 will be described.

Figure 1:
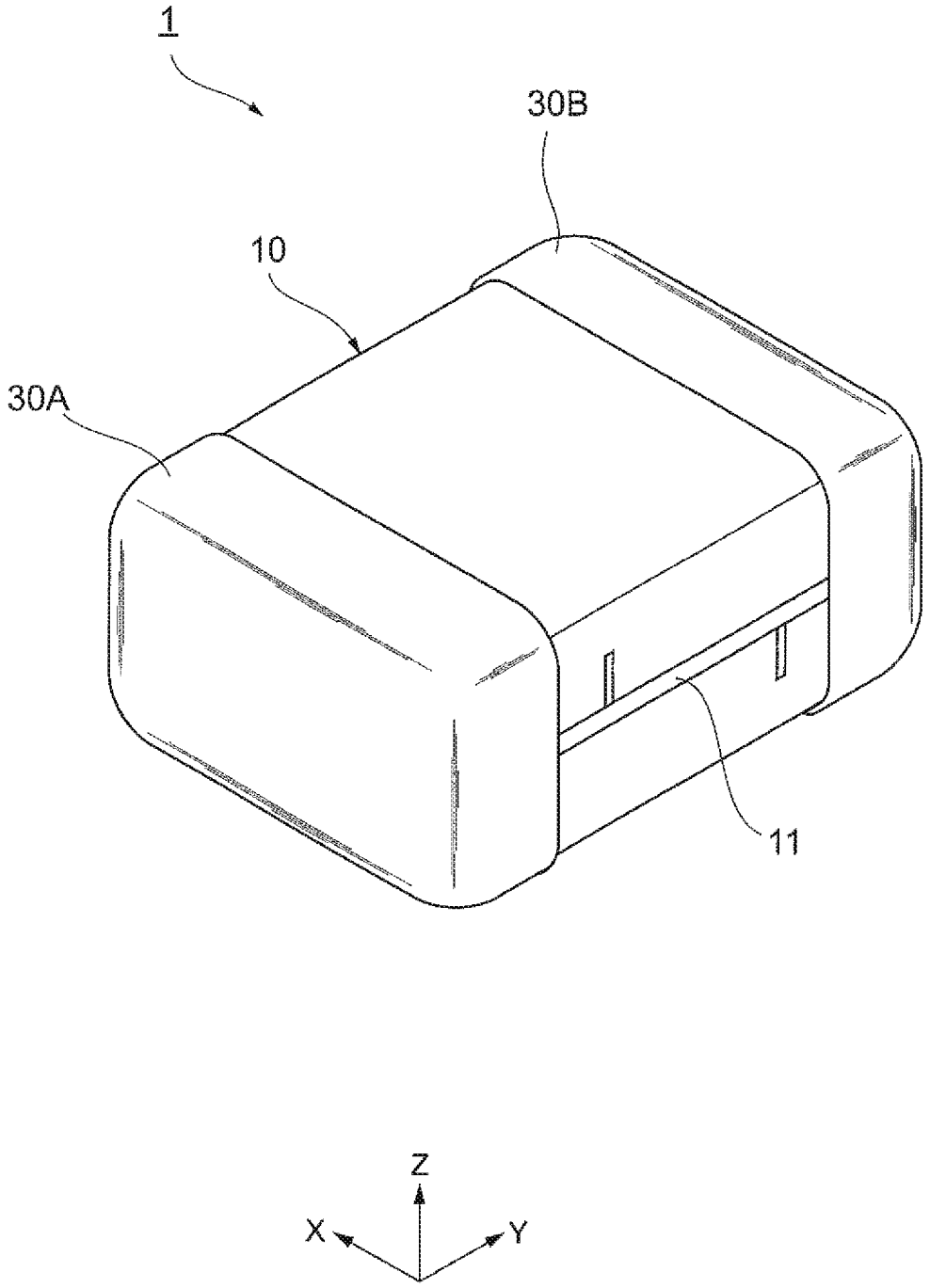
FIG. 1 is a schematic perspective view of the coil component according to an embodiment of the present disclosure.
Figure 2:
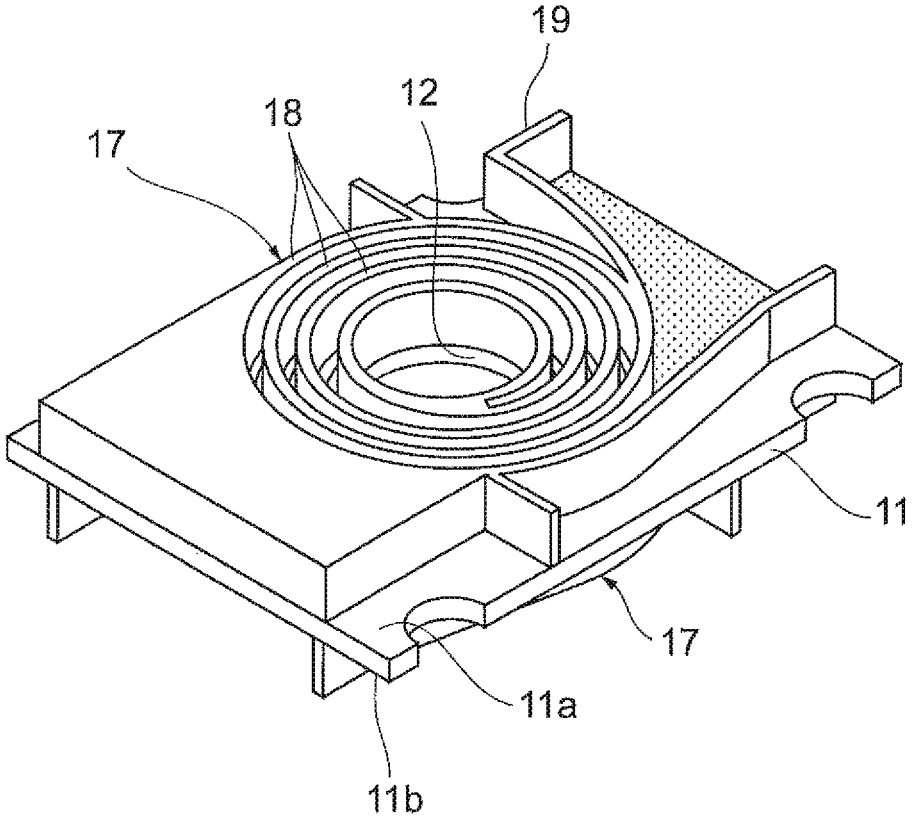
FIG. 2 is a perspective view illustrating the board used for manufacturing of the coil component illustrated in FIG. 1.
Figure 2:
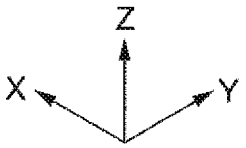

The body section 10 includes a board 11 illustrated in FIG. 2. The board 11 is a tabular rectangular member made of a non-magnetic insulating material. A central portion of the board 11 is provided with an approximately circular opening 12 that is penetrated to connect main surfaces 11*a* and 11*b* to each other. As the board 11, a board in which a glass cloth is impregnated with a cyanate resin (BT (bismaleimide triazine) resin: registered trademark) and which has a thickness of 60 μm may be used. In addition to the BT resin, a polyimide, an aramid, or the like may be used. As a material of the board 11, ceramic or glass may be used. As the material of the board 11, a mass-produced material for board may be used, such as a resin material used in a BT printed board, an FR4 printed board, or an FR5 printed board.

Figure 3:
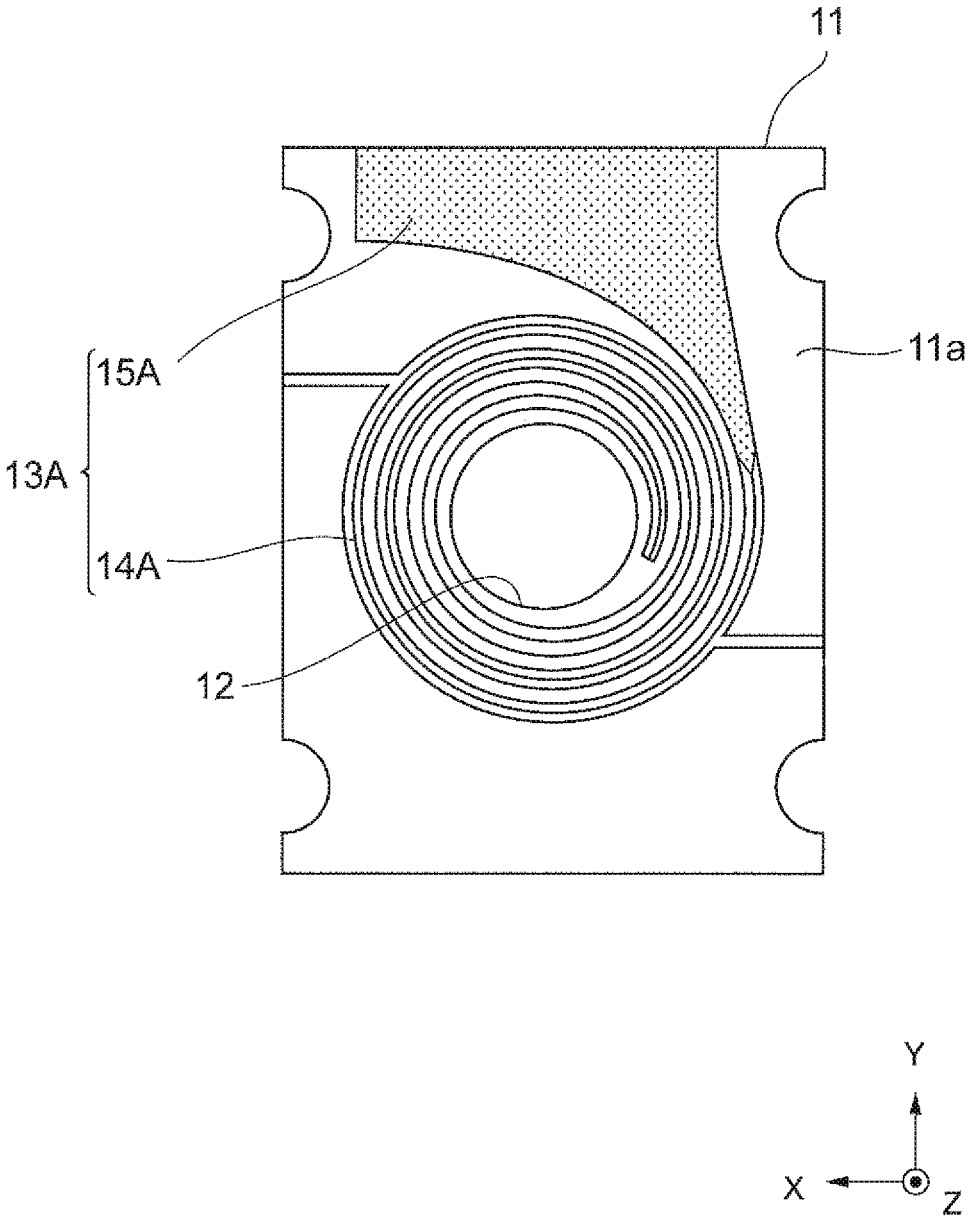
FIG. 3 is a top view illustrating the seed pattern of the board illustrated in FIG. 2.

As illustrated in FIG. 3, the board 11 is formed with a seed pattern 13A for causing coils 13 (to be described below) to be subjected to plating growth on the respective main surfaces 11*a* and 11*b*. The seed pattern 13A has a helical pattern 14A that goes around the opening 12 of the board 11, and an end portion pattern 15A that is formed at an end portion of the board 11 in the Y direction. These patterns 14A and 15A are formed continuously and integrally. An electrode extracting direction at the coil 13 provided at the one main surface 11*a* side is opposite to that at the coil 13 provided at the other main surface 11*b* side. For this reason, the end portion pattern 15A of the one main surface 11*a* side and the end portion pattern of the other main surface 11*b* side are formed at the end portions of the board 11 which differ from each other in the Y direction.

Back to FIG. 2, a resin body 17 is provided on each of the main surfaces 11*a* and 11*b* of the board 11. The resin body 17 is a thick film resist that is patterned by publicly known photolithography. The resin body 17 has resin walls 18 that define a growth region of winding part 14 of the coil 13, and resin walls 19 that define a growth region of an extracting electrode part 15 of the coil 13.

Figure 4:
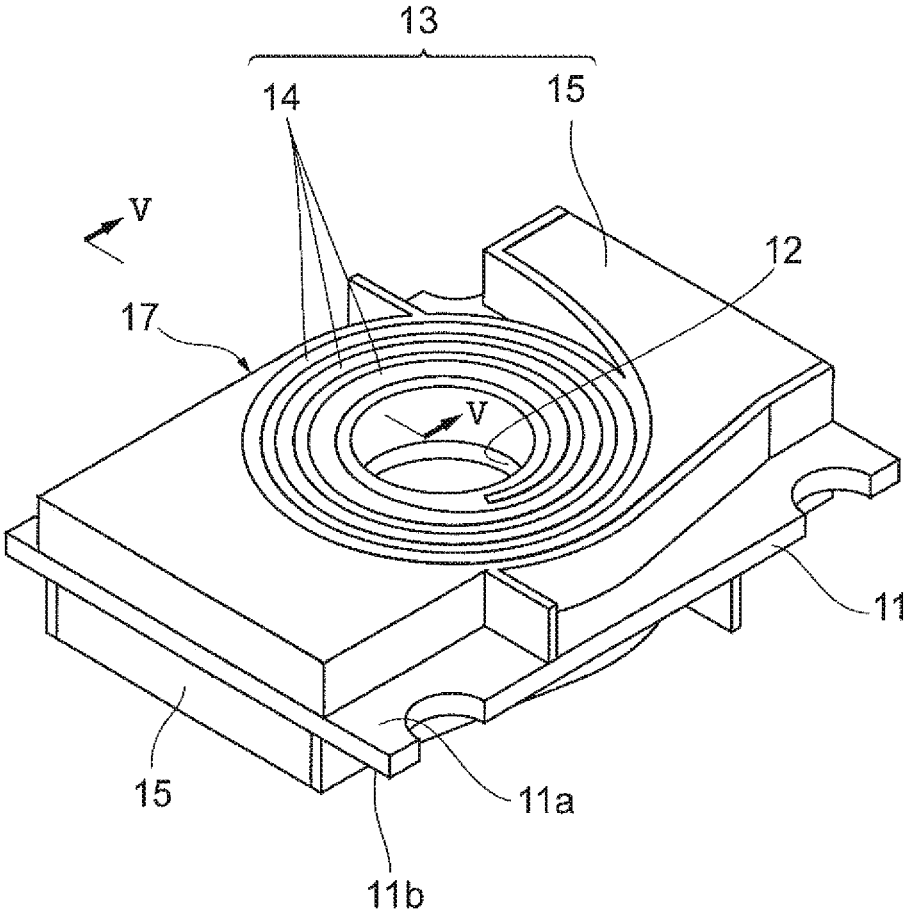
FIG. 4 is a perspective view illustrating one process of the method of manufacturing the coil component illustrated in FIG. 1.
Figure 4:
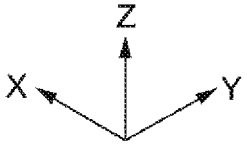

FIG. 4 illustrates a state of the board 11 when the coil 13 is subjected to plating growth using the seed pattern 13A. The plating growth of the coil 13 may employ a publicly known plating growth method.

The coil 13 is formed of copper, and has the winding part 14 formed on the helical pattern 14A of the seed pattern 13A, and the extracting electrode part 15 formed on the end portion pattern 15A of the seed pattern 13A. When viewed in a top view, the coil 13 is the same as the seed pattern 13A, and has a shape of a planarly spiraled air core coil extending to be parallel to each of the main surfaces 11*a* and 11*b* of the board 11. In greater detail, the winding part 14 of the board upper surface 11*a* is counterclockwise rotating spiral in a direction directed to the outside when viewed from the upper surface side, and the winding part 14 of the board lower surface 11*b* is counterclockwise rotating spiral in a direction directed to the outside when viewed from the lower surface side. Both of the coils 13 of the board upper and lower surfaces 11*a* and 11*b* have end portions interconnected via a through-hole that is separately provided adjacent to the opening 12. When an electric current flows to both of the coils 13 in one direction, rotating directions in which the electric current of both of the coils 13 flows are the same, and thus magnetic fluxes generated at the coils 13 are overlapped and intensified.

Figure 5:
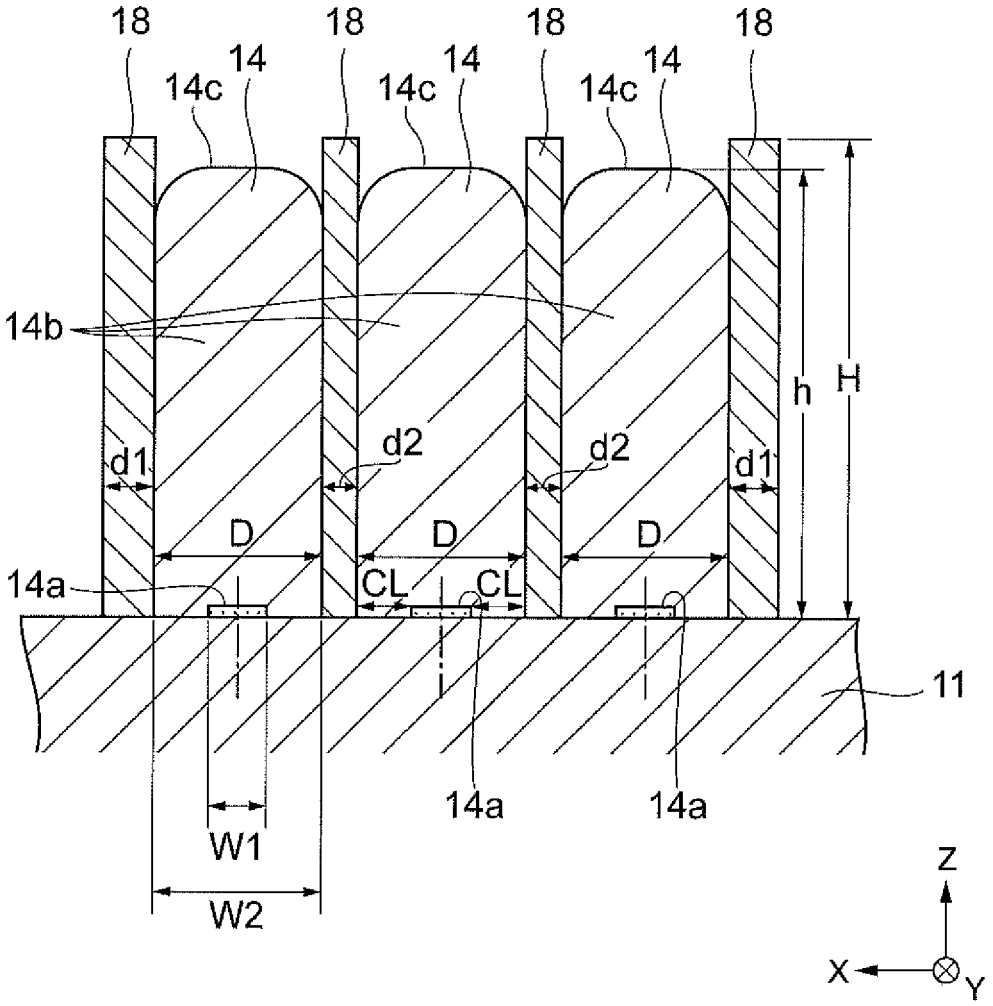
FIG. 5 is a sectional view taken along the line V-V of FIG. 4.

FIG. 5 illustrates a state of the board 11 after the plating growth illustrated in FIG. 4, and a sectional view taken along a line V-V of FIG. 4.

As illustrated in FIG. 5, the resin walls 18 having rectangular cross sections extending long in the normal direction (Z direction) of the board 11 are formed on the board 11, and the winding part 14 of the coil 13 grow among these resin walls 18 in the Z direction. The growth region of the winding part 14 of the coil 13 is previously defined by the resin walls 18 formed on the board 11 prior to the plating growth.

The winding part 14 of the coil 13 is made up of a seed part 14*a* that is a part of the helical pattern 14A, and a plating part 14*b* that is subjected to plating growth on the seed part 14*a*, and is formed as the plating part 14*b* gradually grows around the seed part 14*a*. At this point, the winding part 14 of the coil 13 grows to fill a space defined between the two neighboring resin walls 18, and is formed in the same shape as the space defined between the resin walls 18. As a result, the winding part 14 of the coil 13 has a shape extending long in the normal direction (Z direction) of the board 11. That is, the shape of the space defined between the resin walls 18 is adjusted, and thereby the shape of the winding part 14 of the coil 13 is adjusted, and the winding part 14 of the coil 13 can be formed in a shape as designed.

Also, clearances CL are provided between the seed part 14*a* and the left and right resin walls 18, and the seed part 14*a* is separated from each of the left and right resin walls 18 by a predetermined distance. In the example illustrated in FIG. 5, the center of the seed part 14*a* is located at the middle position (an alternate long and short dash line of the figure) between the left and right resin walls 18, and the left and right clearances CL of the seed part 14*a* have the same size. Further, when a width of the seed part 14*a* is defined as W1, and an interval between the left and right resin walls is defined as W2, W1/W2≥⅕. The interval W2 between the left and right resin walls is equal to a thickness D of the plating part 14*b* of the aforementioned winding part 14.

A cross section size of the winding part 14 of the coil 13 has a height of 50 to 260 μm, a width (thickness) of 10 to 260 μm, and an aspect ratio of 1 to 20 by way of example. The aspect ratio of the winding part 14 of the coil 13 may be 2 to 10, or 10 to 20. A cross section size of the resin wall 18 has a height of 50 to 300 μm, a width (thickness) of 5 to 30 μm, and an aspect ratio of 5 to 30 by way of example. The aspect ratio of the resin wall 18 may be 10 to 30. The cross section size of the resin wall 18 may have a height of 180 to 300 μm, a width (thickness) of 5 to 12 μm, and an aspect ratio of 15 to 30. A cross section size of the seed part 14*a* has a width of 5 to 300 μm (e.g., 15 μm) and a height of 2 to 80 μm (e.g., 10 μm). Also, a size of the clearance CL is 1 to 40 μm (e.g., 20 μm).

When the winding part 14 of the coil 13 grows between the two neighboring resin walls 18, it grows while coming into contact with inner surfaces of the resin walls 18 defining the growth region. At this point, neither a mechanical bond nor a chemical bond occurs between the winding part 14 of the coil 13 and the resin wall 18. That is, the winding part 14 of the coil 13 is subjected to plating growth without being bonded to the resin walls 18, and is interposed between the resin walls 18 in the non-bonded state. The "non-bonded state" in the present specification refers to a state in which a mechanical bond such as an anchor effect and a chemical bond such as a covalent bond do not occur.

As illustrated in FIG. 5, the height h of the winding part 14 of the coil 13 is lower than the height H of the resin wall 18 (h<H). That is, the plating growth of the winding part 14 of the coil 13 is adjusted to be stopped at a position lower than the height H of the resin wall 18. If the height h of the winding part 14 of the coil 13 is lower than the height H of the resin wall 18, the winding part 14 has a thickness according to a design size over a height direction. Also, if the height h of the winding part 14 of the coil 13 is higher than the height H of the resin wall 18, there occurs a situation in which the neighboring parts of the winding part 14 come into contact with each other or a thickness of an insulator 40 or a junction layer 41 (to be described below) cannot be sufficiently secured. This becomes a cause that breakdown voltage resistance of the coil 13 is reduced.

Also, the thickness D of the winding part 14 of the coil 13 is uniform over the height direction. This is because the interval between the neighboring resin walls 18 is uniform over the height direction.

In the aspect illustrated in FIG. 5, like the winding part 14 of the coil 13, each of thicknesses d1 and d2 of the resin walls 18 is also uniform over the height direction. As a result, the interval of the winding part 14 of the coil 13 is uniform over the height direction. That is, the winding part 14 of the coil 13 has a structure in which a place in which it is locally thin with respect to the height direction (i.e. a place in which the breakdown voltage resistance is locally reduced) is not present or is hardly present.

Also, since the space defined by the resin walls 18 is open at its upper end, and an upper end portion of the resin wall 18 does not wrap around so as to cover an upper side of the winding part 14, a degree of freedom in designing the upper side of the winding part 14 is high. That is, it is possible to select an aspect in which an arbitrary layer is formed on the winding part 14 or an aspect in which no layer is formed on the winding part 14.

Figure 6:
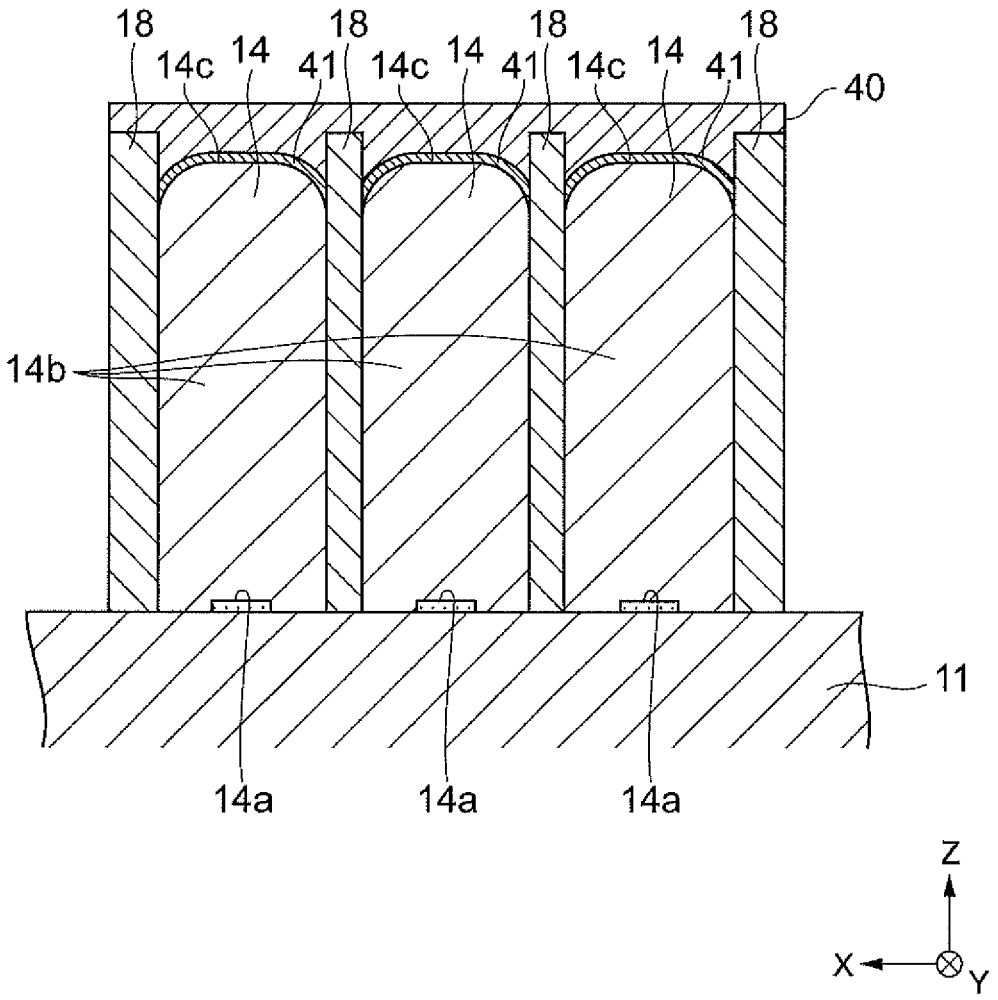
FIG. 6 is a sectional view illustrating the insulator provided on the winding part of the coil.

When the layer is formed on the winding part 14, various forms and materials of the layer can be selected. For example, as illustrated in FIG. 6, the insulator 40 may be provided on the winding part 14 to enhance an insulation property between metal magnetic powder included in a covering resin 21 (to be described below) and the winding part 14. The insulator 40 may be formed of an insulating resin or an insulating magnetic material. Also, the insulator 40 is in direct or indirect contact with upper surfaces 14*c* of the winding part 14, and integrally covers the winding part 14 and the resin walls 18. The insulator 40 may be configured to selectively cover the winding part 14 only. Also, to increase bondability between the winding part 14 and the insulator 40, a predetermined junction layer (e.g., a blackened layer caused by oxidation of copper plating) 41 may be provided.

Further, as illustrated in FIG. 5, the thickness d1 of the resin wall 18 that is located outermost among the plurality of resin walls 18 is thicker than the thickness d2 of the resin wall 18 located inside thereof (d1>d2). In this case, rigidity is given against a pressure received in the Z direction when the coil component 1 is manufactured or used. The resin wall 18 whose thickness is thicker is disposed at the outermost position, and thereby this portion mainly receives the pressure. From the viewpoint of the rigidity, both of the resin walls 18 located at both ends are thicker than the resin walls 18 located inside thereof.

The aforementioned plating growth of the coil 13 is performed on both of the main surfaces 11*a* and 11*b* of the board 11. The ends of the coils 13 of both of the main surfaces 11*a* and 11*b* are connected and conducted in the opening of the board 11.

Figure 7:
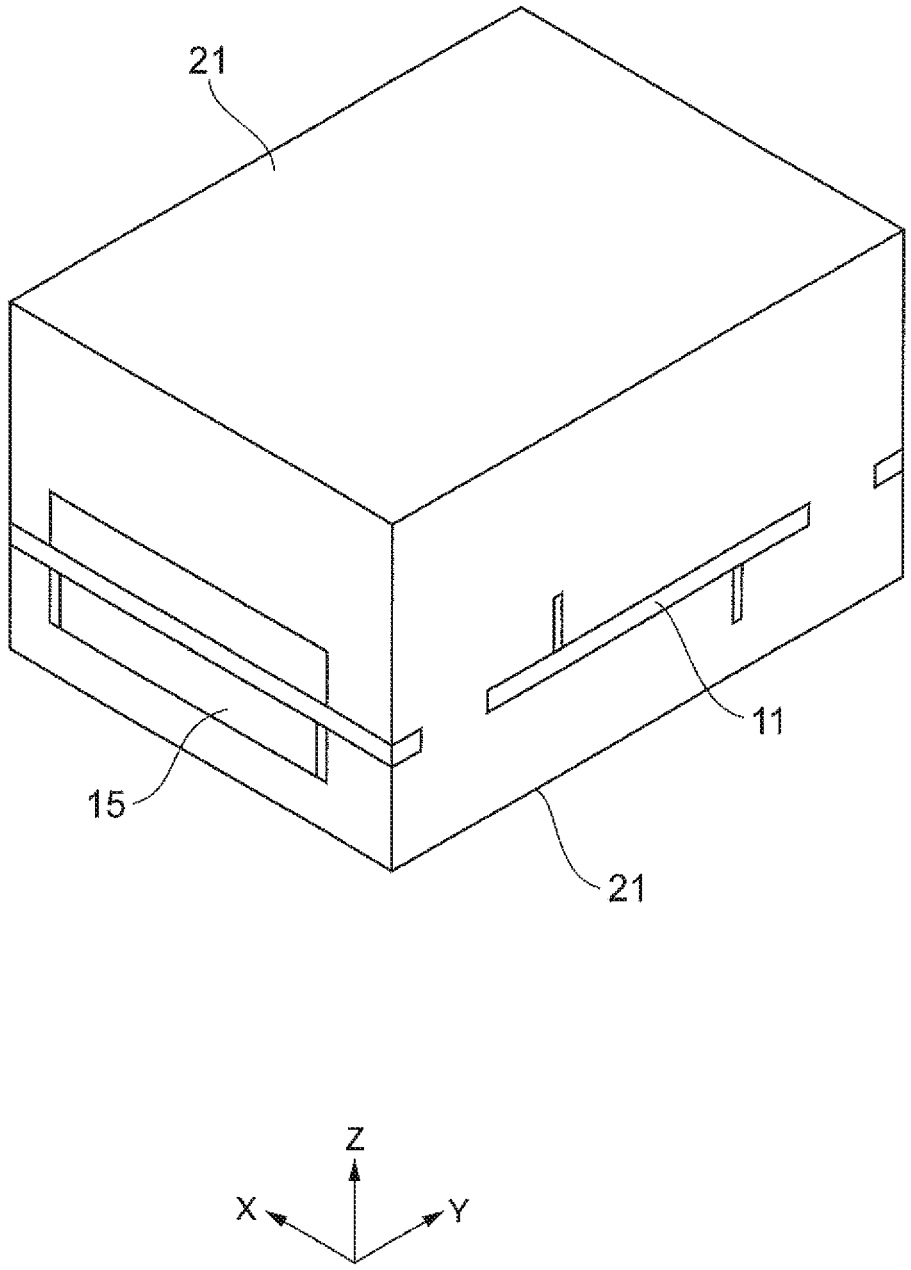
FIG. 7 is a perspective view illustrating one process of the method of manufacturing the coil component illustrated in FIG. 1.

After the coils 13 are subjected to plating growth on the board 11, the board 11 is covered entirely with the covering resin 21 as illustrated in FIG. 7. That is, the covering resin 21 integrally covers the coils 13 and the resin bodies 17 of the main surfaces 11*a* and 11*b* of the board 11. The resin bodies 17 constitute a part of the coil component 1 while remaining in the covering resin 21. The covering resin 21 is composed of a metal magnetic powder-containing resin, is formed on the board 11 that is in a wafer state, and then is hardened, thereby being formed.

The metal magnetic powder-containing resin constituting the covering resin 21 is composed of a resin in which metal magnetic powder is dispersed. The metal magnetic powder may be composed of, for instance, an iron-nickel alloy (a permalloy), carbonyl iron, amorphous, a Fe—Si—Cr alloy in a state of amorphous or crystalline, sendust, or the like. The resin used in the metal magnetic powder-containing resin is, for instance, a thermosetting epoxy resin. A content of the metal magnetic powder included in the metal magnetic powder-containing resin is 90 to 99 wt % by way of example.

Figure 8:
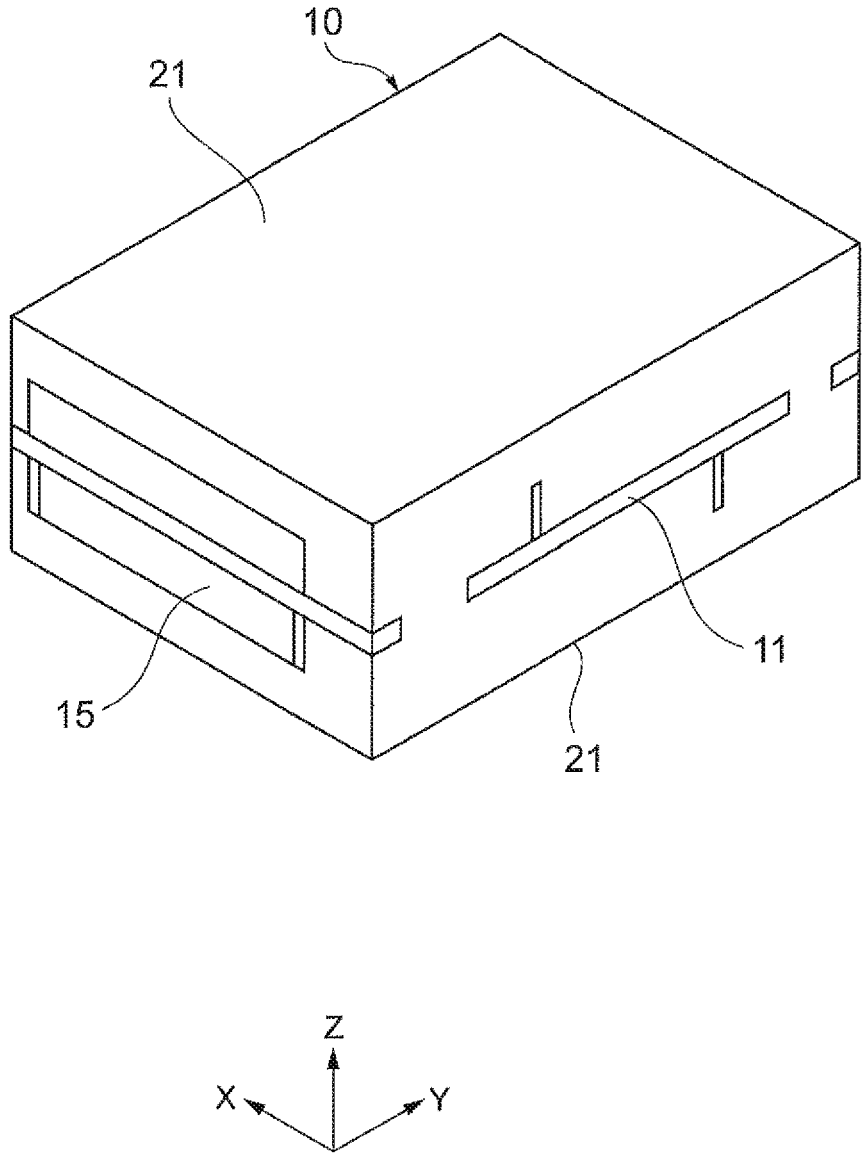
FIG. 8 is a perspective view illustrating one process of the method of manufacturing the coil component illustrated in FIG. 1.

Further, the body section 10 illustrated in FIG. 8 is obtained by dicing to be formed into a chip. After being formed into the chip, chamfering of an edge may be performed by, for instance, barrel polishing as needed.

Finally, the external terminal electrodes 30A and 30B are provided for end faces (end faces opposite to each other in the Y direction) to which the end portion patterns 15A of the body section 10 are exposed so as to be electrically connected with the end portion patterns 15A, and thereby the coil component 1 is completed. The external terminal electrodes 30A and 30B are electrodes for connection to a circuit of the board on which the coil component is mounted, and may be formed in a multilayered structure. For example, the external terminal electrodes 30A and 30B may be formed by applying a resin electrode material to the end faces and then performing metal plating on the resin electrode material. Cr, Cu, Ni, Sn, Au, solder, etc. may be used for the metal plating of the external terminal electrodes 30A and 30B.

Here, the plating growth of the winding part 14 is described with reference to FIGS. 9 and 10.

Figure 9:
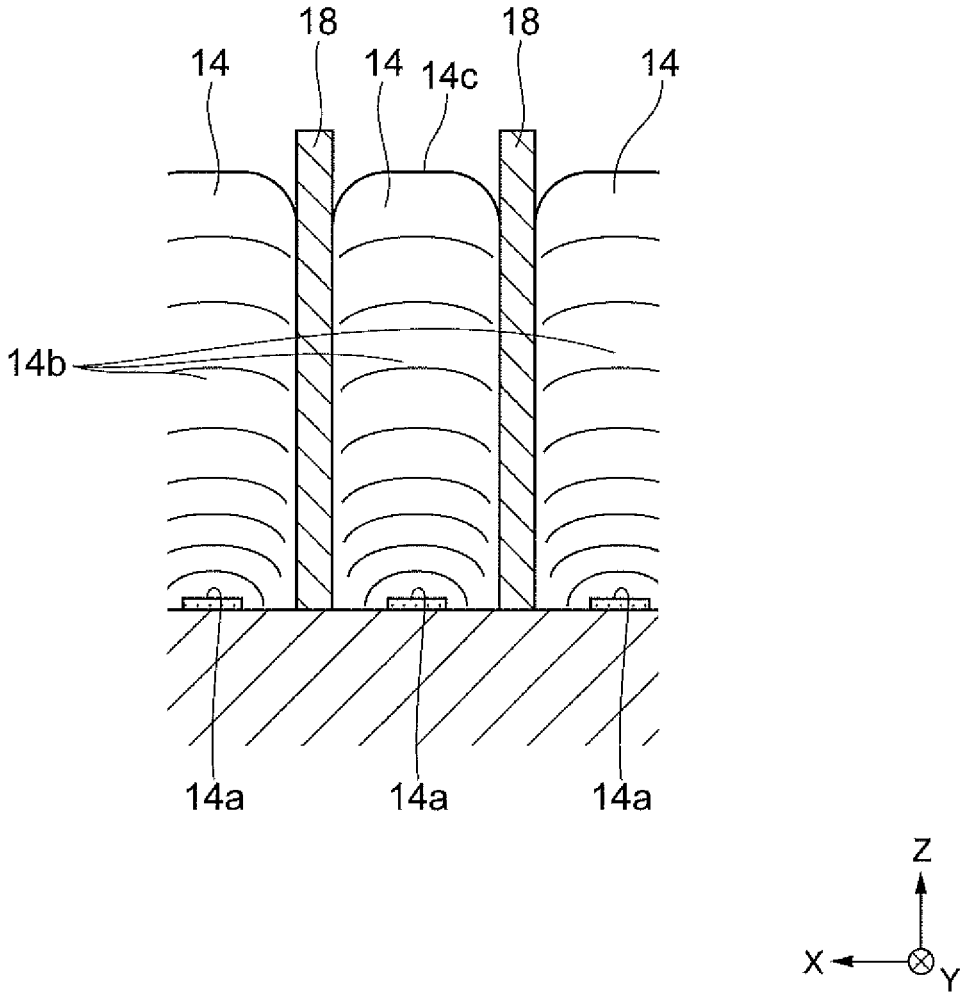
FIG. 9 is a view illustrating a behavior of plating growth of the winding part.

In the aforementioned coil component 1, as illustrated in FIG. 9, the clearances CL are provided between the seed part 14*a* and the left and right resin walls 18. For this reason, the plating part 14*b* is hardly impeded by the left and right resin walls 18 in its growth stage (particularly, in an initial growth stage). Therefore, the plating part 14*b* uniformly grows left and right at the same speed in an upward direction (in a normal direction of the main surface 11*a* of the board 11). As a result, a thickness of the winding part 14 is also almost even, and the winding part 14 having the upper surface 14*c* parallel to the main surface 11*a* of the board 11 is obtained.

Figure 10:
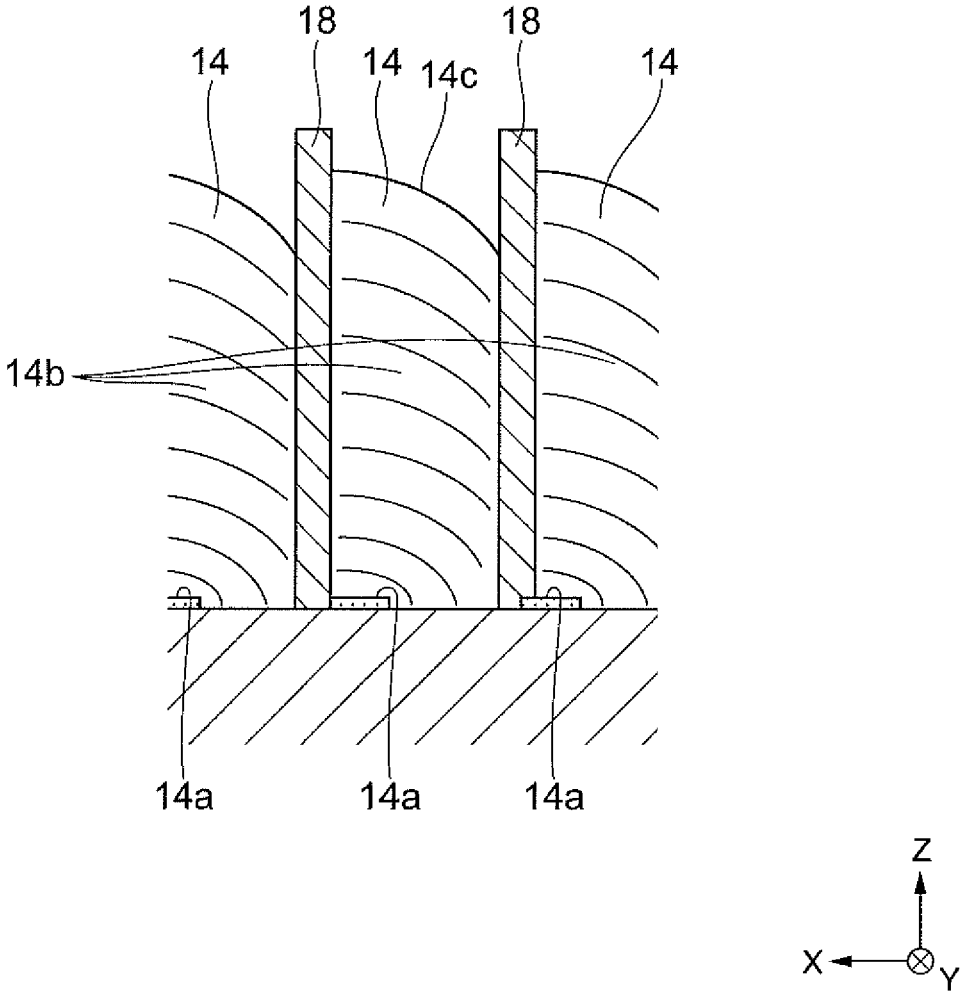
FIG. 10 is a view illustrating a behavior of plating growth of the winding part.

For comparison, an aspect in which no clearances CL are present between the seed part 14*a* and the left and right resin walls 18 is illustrated in FIG. 10. As the aspect in which no clearances CL are present, there may be an aspect in which the seed part 14*a* is in contact with the resin wall 18 or has entered into the resin wall 18. In this case, the plating part 14*b* is impeded in growth by the resin walls 18 that is in contact therewith in the initial growth stage, and then grows in an oblique state. As a result, a thickness of the obtained winding part 14 differs greatly left and right, and the winding part 14 having a great change in the left and right thicknesses is obtained. In the example illustrated in FIG. 10, the winding part 14 is thick in the thickness of the left side at which the seed part 14*a* is in contact with the resin wall 18, and is relatively thin in the thickness of the right side. At this point, the upper surface 14*c* of the winding part 14 is greatly inclined with respect to the main surfaces 11*a* of the board 11.

As described above, according to the aforementioned coil component 1, since each of the pair of neighboring resin walls 18 and the seed part 14*a* between the pair of resin walls 18 are separated by a predetermined distance, the plating part 14*b* grown on the seed part 14*a* is easy to grow uniformly between the pair of neighboring resin walls 18. For this reason, the winding part 14 whose surface is gentle and in which a change in thickness is prevented is obtained by the plating growth.

Especially, in the coil component 1, since the seed part 14*a* is formed at the middle position between the left and right resin walls 18, and the left and right clearances CL have the same magnitude, the winding part 14 having a symmetrical shape with respect to the middle position between the left and right resin walls 18 is easily obtained, and the change in thickness is further prevented.

On the other hand, when each of the pair of neighboring resin walls 18 and the seed part 14*a* between the pair of resin walls 18 are not separated, the winding part 14 having a great change in thickness is obtained. Especially, as illustrated in FIG. 10, when the seed part 14*a* has entered into the resin wall 18, a thickness of the resin wall 18 of this part becomes thinner, and there occurs a problem that a breakdown voltage between the winding part 14 adjacent to each other across the resin wall 18 is reduced.

In the coil component 1, since the width W1 of the seed part 14*a* and the interval W2 of the resin walls 18 satisfy a relation of W1/W2≥⅕, the width of the seed part 14*a* is designed such that a bonding force having a sufficient magnitude to an extent that the seed part 14*a* is not peeled from the board 11 is obtained. Thereby, a situation in which the seed part 14*a* is peeled from the board 11 is prevented.

Further, according to the coil component 1, since the winding part 14 of the coil 13 is interposed between the plurality of resin walls 18 in the non-bonded state, the winding part 14 of the coil 13 and the resin walls 18 can be displaced relative to each other. For this reason, even when there is a change in ambient temperature, for instance when a use environment of the coil component 1 becomes high in temperature, and a stress caused by a difference in coefficient of thermal expansion between the winding part 14 of the coil 13 and the resin wall 18 occurs, the winding part 14 of the coil 13 and the resin walls 18 move relatively, and thereby the stress is relieved.

Also, according to a method of manufacturing the coil component 1, the winding part 14 of the coil 13 is subjected to plating growth to be interposed between the resin walls 18 of the resin body 17. That is, before the coil 13 is covered with the covering resin 21, the resin wall 18 is already interposed in the interval of the winding part 14 of the coil 13 all over. For this reason, there is no need to separately fill a resin in the interval of the winding part 14 of the coil 13, and a dimensional accuracy of the resin in the interval of the winding part 14 of the coil 13 is stabilized by the resin wall 18.

The coil component 1 is not limited to the above form, and can employ various forms.

For example, the magnitudes of the left and right clearances CL of the seed part 14*a* need not necessarily be equal to each other. As long as the clearance CL is provided between the seed part 14*a* and each of the resin walls 18, the seed part 14*a* may be disposed closer to one of the resin walls 18.

What is claimed is:

1. A coil component comprising:

a board;

a coil provided on and in direct contact with a main surface of the board and having a seed part disposed on the main surface of the board and a plating part formed by plating growth on the seed part and on the main surface of the board;

a resin body provided on the main surface of the board and having a plurality of resin walls between which winding part of the coil extends;

an insulator layer provided on the resin body to sandwich the resin body between the insulator layer and the main surface of the board;

a junction layer provided between and in contact with the insulator layer and the resin body; and a covering resin composed of a magnetic powder-containing resin and configured to integrally cover the coil and the resin body of the main surface of the board, wherein the board, the coil, the resin body, and the covering resin constitute a body section, wherein the body section has two end faces separated and facing each other in a direction parallel to the board, and two side faces separated and facing each other in a direction parallel to the board; the board extends up to both end faces and both side faces; and the covering resin is provided on the board and in outer peripheral areas of the board beyond both the winding part of the coil and the resin walls of the resin body, wherein each of a pair of neighboring resin walls and the seed part between the pair of resin walls are separated by a predetermined distance, and the seed part between the pair of resin walls is formed at least at a middle position between the pair of neighboring resin walls, wherein, among the plurality of resin walls arranged on the main surface of the board, the resin wall located innermost is thicker than the resin wall adjacent thereto, and wherein the predetermined distance is larger than a thickness, in a direction in which the pair of resin walls are separated by the predetermined distance, of the adjacent resin wall, and larger than a width of the seed part in the direction.

2. The coil component according to claim 1, wherein each of the pair of neighboring resin walls and the seed part between the pair of resin walls are separated by an equal distance.

3. The coil component according to claim 1, wherein, when the width of the seed part between the pair of resin walls is defined as W1, and an interval between the pair of resin walls is defined as W2, W1/W2≥⅕.

4. The coil component according to claim 1, wherein cross section shape of the resin wall of the resin body is rectangular shape.

5. The coil component according to claim 4, wherein aspect ratio of the resin wall of the resin body is greater than 1, and the resin wall extends long in normal direction of the main surface of the board.

6. The coil component according to claim 1, wherein cross section shape of the winding part of the coil is rectangular shape.

7. The coil component according to claim 6, wherein aspect ratio of the winding part of the coil is greater than 1, and cross section of the winding part extends long in normal direction of the main surface of the board.

8. The coil component according to claim 1, wherein the resin wall of the resin body is higher than the winding part of the coil.

9. The coil component according to claim 1, wherein:

the resin body is provided before the coil is subjected to plating growth on the main surface of the board; and the winding part of the coil is not bonded to the resin wall of the resin body.

10. The coil component according to claim 1, wherein, among the plurality of resin walls arranged on the main surface of the board, the resin wall located outermost is thicker than the resin wall adjacent thereto.

* * * * *